United States Patent [19]

Sergeant et al.

[11] Patent Number: 4,820,189

[45] Date of Patent: Apr. 11, 1989

[54] METHOD AND APPARATUS FOR ELECTRICAL WIRING OF STRUCTURAL ASSEMBLIES

[75] Inventors: Ronald G. Sergeant, Miami, Fla.; Allan J. Sykora, Kernersville, N.C.

[73] Assignee: AMP Incorporated, Harrisburgh, Pa.

[21] Appl. No.: 134,328

[22] Filed: Dec. 17, 1987

[51] Int. Cl.[4] ..... H01R 13/62

[52] U.S. Cl. ..... 439/395; 439/400; 439/401

[58] Field of Search ..... 439/395, 397, 400, 401

[56] References Cited

U.S. PATENT DOCUMENTS

| | | | |
|---|---|---|---|
| 3,772,571 | 11/1973 | Merry et al. | 317/99 |
| 3,840,962 | 10/1974 | Coller | 29/203 B |
| 3,871,072 | 3/1975 | Folk | 29/628 |
| 3,887,999 | 6/1975 | Ross et al. | 29/628 |
| 3,891,013 | 6/1975 | Folk et al. | 140/147 |
| 3,970,354 | 7/1976 | Hopkins et al. | 339/113 R |
| 4,076,365 | 2/1978 | Ross et al. | 339/107 |
| 4,094,566 | 6/1978 | Dola et al. | 339/14 R |
| 4,125,137 | 11/1978 | Shatto, Jr. | 140/147 |
| 4,132,251 | 1/1979 | Folk et al. | 140/147 |
| 4,132,252 | 1/1979 | Shatto, Jr. | 140/147 |
| 4,181,384 | 1/1980 | Dola et al. | 339/14 R |
| 4,367,909 | 1/1983 | Shatto, Jr. et al. | 339/176 MF |
| 4,387,509 | 6/1983 | Dechelette | 29/850 |
| 4,614,028 | 9/1986 | Rich | 29/749 |
| 4,684,765 | 8/1987 | Beck et al. | 174/68.5 |

FOREIGN PATENT DOCUMENTS

| | | |
|---|---|---|
| 2133241 | 1/1973 | Fed. Rep. of Germany . |
| 2507853 | 12/1982 | France . |
| 0144759 | 4/1976 | Japan . |
| 0144787 | 5/1976 | Japan . |
| 0144789 | 5/1976 | Japan . |

*Primary Examiner*—William L. Sikes
*Assistant Examiner*—Akm E. Ullah
*Attorney, Agent, or Firm*—Eric J. Groen

[57] ABSTRACT

Method and apparatus embrace implanting electrical conductor wires (16) into grooves (38) in a structural element (30) of an apparatus unit (10) to form a harness (14) for power and signal distribution in said unit and thereafter terminating the wires by terminals (70) and adding components (82) to the structural element. Wire placement features rolling of the wire into grooves of the structural element with grooves provided in tooling to extend wires along the structural element. Rolling is achieved along paths extending in X and Y directions. The structural element bearing wires, terminals, and connectors and components is then mechanically secured to the apparatus unit to form a structural part thereof.

22 Claims, 13 Drawing Sheets

18
16
104
38'
60
114
39
110
116
38
102
16
60
16
38
38
16

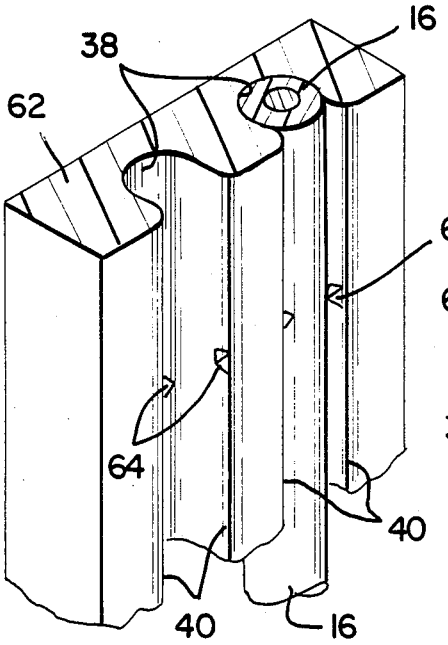
Fig. 6A
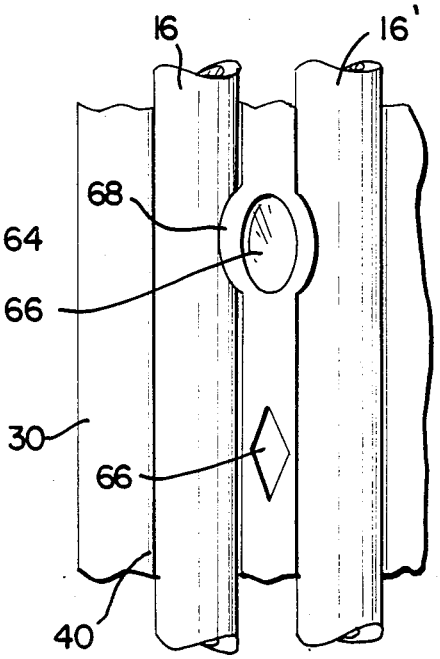
Fig. 6B
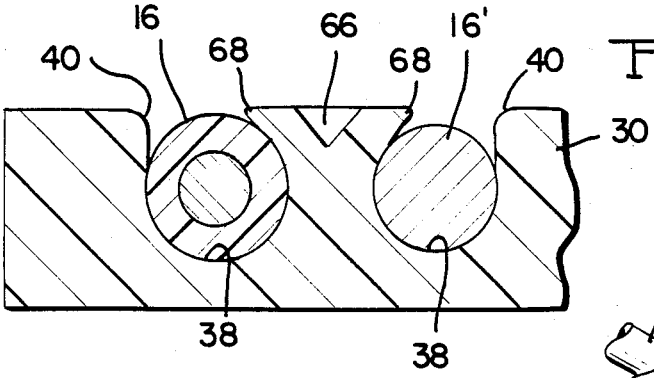
Fig. 6C
Fig. 6D
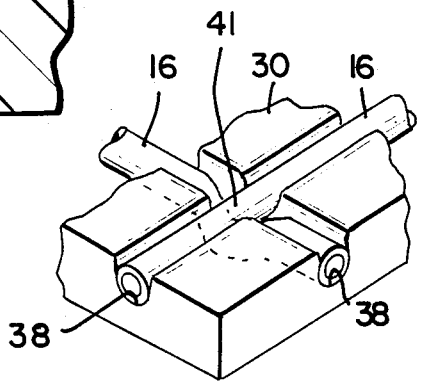

METHOD AND APPARATUS FOR ELECTRICAL WIRING OF STRUCTURAL ASSEMBLIES

The present invention relates to a method and apparatus for harness making wherein the electrical conductor wires which form the harness are implanted into a frame which is a structural member of the apparatus served by the harness with components added to such frame and the frame being mounted into the apparatus served thereby.

BACKGROUND OF THE INVENTION

Electrical harnesses are typically made of electrical conductor wires which are mostly individual, stranded, and insulated wires with an occasional uninsulated stranded or solid wire utilized for grounding or the like. These wires are typically terminated by electrical terminals and/or connectors and formed into some general shape suitable for inventory and handling by the use of tape or harness ties. Fasteners may or may not be employed to affix the harness to the apparatus in which the harness is used. The harness wires serve the function of supplying power to the various components of such apparatus or signals for either control or machine intelligence purposes and, as mentioned, ground and/or shielding circuit functions. The harness may be a simple one, having only several short wires but a few inches in length utilized to interconnect the components of a simple circuit in an apparatus such as a camera or smoke alarm or, it may have literally hundreds of wires terminated in very expensive connectors and utilized to interconnect all of the different devices and components of a complex circuit as in an aircraft. The harness may be premade in large part to be loaded into the apparatus on a production line as, for example, with respect to appliances such as washers, dryers, copy machines, stoves, refrigerators and the like; or, added piece meal in subassembly fashion as the apparatus moves along a production line. Generally speaking, a harness is a flexible assembly having a non-rigid shape, such as a plurality of discrete wires which are bundle tied together and terminated at ends thereof for interconnection to a panel or other end components. These harnesses are difficult to handle by machine, making it difficult to automate either harness making or harness handling. This fact has frustrated industry for decades and, notwithstanding substantial efforts to automate or robotize harness making or harness manipulation, most harnesses are currently manufactured and installed in a highly labor intensive manner which impacts not only on cost but also on quality.

A significant step toward automatic wire handling in the last decade has come with the concept of implanting conductor wires into preformed grooves having a desired geometry and/or distribution. This technique is taught in U.S. Pat. Nos. 3,891,013 and 3,871,072, as well as in U.S. Pat. No. 4,076,365. These patents deal with spreading conductors for the purpose of location for termination and, in the latter case, include grooves in the connector housing into which conductor wires are driven. U.S. Pat. No. 4,132,251 teaches a similar concept but employs a tool which rolls the wires into the grooves. A further teaching yet is found in U.S. Pat. Nos. 4,132,252 and 4,125,137 relating to rolling techniques wherein wires are spread into grooves by rolling tools preparatory to termination.

The wire implanting technique disclosed in this prior art allows a number of wires to be positioned and placed rather exactly for subsequent processing such as termination in an automatic or semiautomatic fashion which minimizes the need for labor in handling the different wires and vastly increases the productivity for such wire handling and placement. It represents, nevertheless, only a fraction of the overall labor in forming harnesses or subharnesses, the nature of the harness in being flexible and difficult to handle remaining as a challenge.

SUMMARY OF THE INVENTION

The present invention teaches a method of forming electrical wiring harnesses by implanting electrical conductor wires into grooves laid out in a desirable geometry or pattern to effect wire distribution. Such grooves are formed at least in part in elements which have a structural function relative to an apparatus served by the wiring harness. In a specific application, portions of grooves are also provided in tooling which has no structural function related to the apparatus served by the harness. The grooves in the structural element are disposed to allow the implanting technique heretofore mentioned to distribute wires between X and Y points in the element and thus in the apparatus. The wires are terminated at the ends or elsewhere along the length thereof in accordance with the needs of the wiring harness and related circuit. The invention method embraces concepts of rolling in order to implant wires. It does this by disposing the roller along a path which traverses X and Y directions over the structural elements; or, the use of distinct rolling steps by one or more rollers. The invention method embraces rolling from the end of a structure such as the end of a frame element or, rolling from the middle of such structure up and then down to effect wire distribution. The invention article embraces the use of grooves in the structural element along with portions thereof which may be deformed to hold wires therewithin. The invention further contemplates the termination of the wires by specially adapted terminals which fit into the frame element, by connectors which similarly are attached to the frame element, and by components which plug into the frame element and are attached thereto.

Accordingly, it is an object of the present invention to provide a novel method and apparatus for producing electrical wiring harnesses and wire distribution incorporated into the structural elements of an apparatus unit. It is a further object of the invention to provide a better way to install conductive wires into devices and apparatus which require a harness. It is still a further object to provide a wire distribution and manipulation technique which lends itself to automation. It is a further object to provide a method and apparatus which allows the manufacture of harnesses, termination of conductive wires, and addition of components through the use of a novel structural member designed into the apparatus requiring wiring, termination, connectors, components, and the like. It is a final object of the invention to provide a method and apparatus which improves the technique of wiring and component interconnection.

BRIEF DESCRIPTION OF THE DRAWINGS

FIG. 3A is a perspective view of the frame element as shown in FIG. 2 but prior to being wired.

FIG. 3B is a cross-sectional view of a portion of the frame of FIG. 3A showing wiring grooves in greater detail.

FIG. 5A is a perspective showing a jig fixture adapted to receive the frame shown in FIG. 3A in conjunction with a roller device.

FIG. 5B is a view of the jig fixture of FIG. 5A with the frame mounted thereon and the roller positioned preparatory to the implantation of wires in the frame.

FIG. 6A is a perspective view showing a segment of the frame element including wire retention details.

FIG. 6B is a plan view of a segment of the frame element including wire retention details of an alternative version.

FIG. 6C is a section taken through the wire retention portion of FIG. 6B.

FIG. 6D is a perspective showing in partial phantom the details of wire cross over in the frame element of the invention.

FIG. 8 is a view of the frame of the invention just prior to the addition of components thereto and following wiring and termination thereof.

DETAILED DESCRIPTION OF THE INVENTION

Figure 1B:
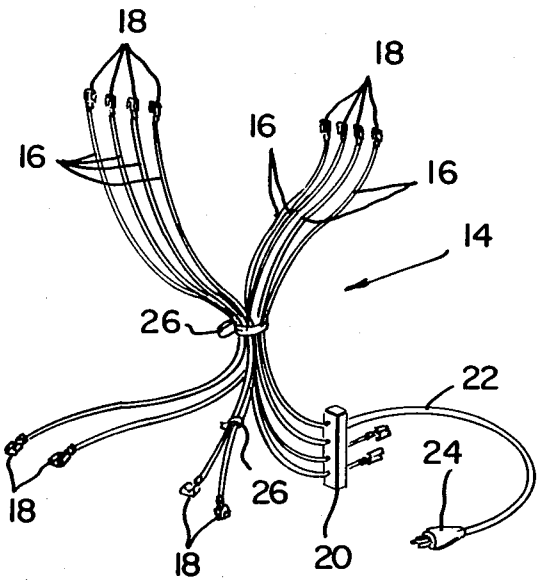
FIGS. 1A and 1B are schematic representations, shown in perspective, of an electric range representing a typical apparatus unit along with its harness in accordance with prior art practice.
Figure 1A:
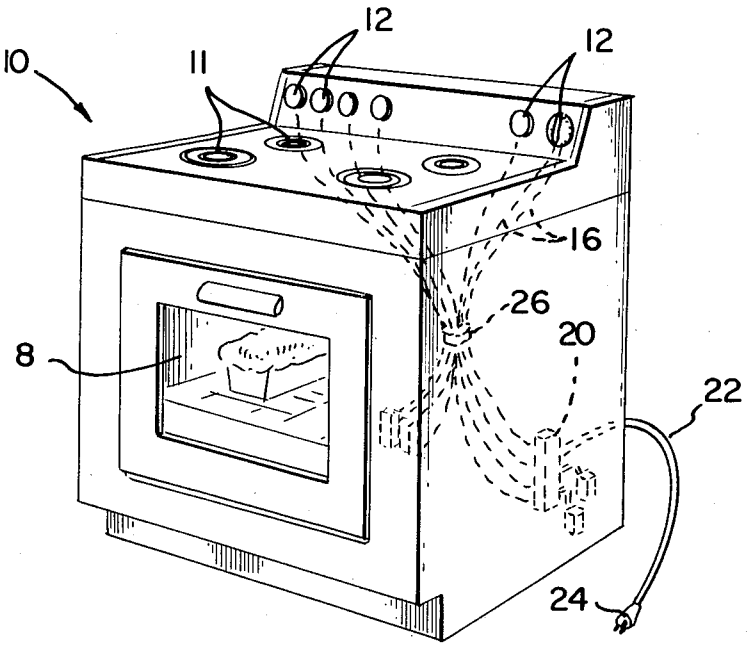

Referring now to FIG. 1A, there is shown an apparatus unit 10 in the form of an electric range having a typical array of top placed burners shown as 11, panel front controls evidenced by knobs 12, and an oven 8. The unit 10 is included to typify a variety of electrical or electronic units representing apparatus requiring a conductive wiring harness suitably terminated and having components which cause the apparatus to function. In general, the wiring harness which is schematically represented in FIG. 1B and is shown in phantom in FIG. 1A installed in the unit 10, both labeled 14, includes a number of electrical conductor wires 16 terminated by terminals or connectors containing terminals labeled 18. A number of wires, typically power carrying wires are further terminated by terminal block 20 to which is connected in use a power cord shown as 22 having at the end the usual utility plug labeled 24. Harnesses such as 14 typically include tape or wire ties as at 26 which fasten the harness wires together and form the different branches thereof. Not shown but understood are additional fastening means which secure the harness within the apparatus unit 10 in an appropriate pattern to interconnect the components contained within the apparatus unit.

Harnesses such as 14 typically contain conductive wires of stranded copper which are principally 14 to 18 AWG in size, with several of the power wires requiring 8 to 12 AWG conductors. Certain of the signal wires are typically on the order of 18 to 22 AWG in size and typically the wires are insulated with protective insulating sheaths, but with one or several of the wires being uninsulated and serving to carry the ground or neutral voltages of an alternating current power supply. The trend to more electronic controls in lieu of electromechanical devices has witnessed the use of insulated wires of smaller and smaller gauge due to reduced current and voltage requirements which tends to make harnesses even more difficult to handle due to the reduced size and increased flexibility and in a sense, fragility of the harness.

Present practice has the individual wire 16 which comprise harness 14 being run on automatic wire handling machines which measure, cut and strip each end of the wires and may terminate one or both of such ends individually. Sets of appropriate wires of appropriate lengths and types are then laid up on what is known as a harness board, most typically made of plywood having nails, screws or other elements affixed thereto to mark the outline of the harness. With the wires laid up, they are suitably taped or bound by harness wire ties with connectors or terminal blocks or other parts of the harness added by hand as a part of the fabrication process. Harnesses thus assembled are then inventoried in an appropriate volume for subsequent transportation and installation into apparatus units such as 10 on a production line where such units are manufactured. As a general practice, the unit 10 has its various electrical and electronic components other than the harness placed upon portions of the unit structure and secured thereto with the harness then being added after all the components have been installed with the appropriate connectors plugged to tab terminals contained on such components. Alternatively, some components are added to the harness prior to its installation.

It is this general approach which has made automation of harness making difficult and even where a degree of automation has been achieved, complicated installation of the flexible harness into the unit served thereby to a point that manual labor is required to be employed. Furthermore, the overall process of manufacturing and inventorying harnesses, storing, shipping and then installing harnesses on a production line is fundamentally incapable with "just in time" manufacturing procedures so desirable in mass production.

Figure 2:
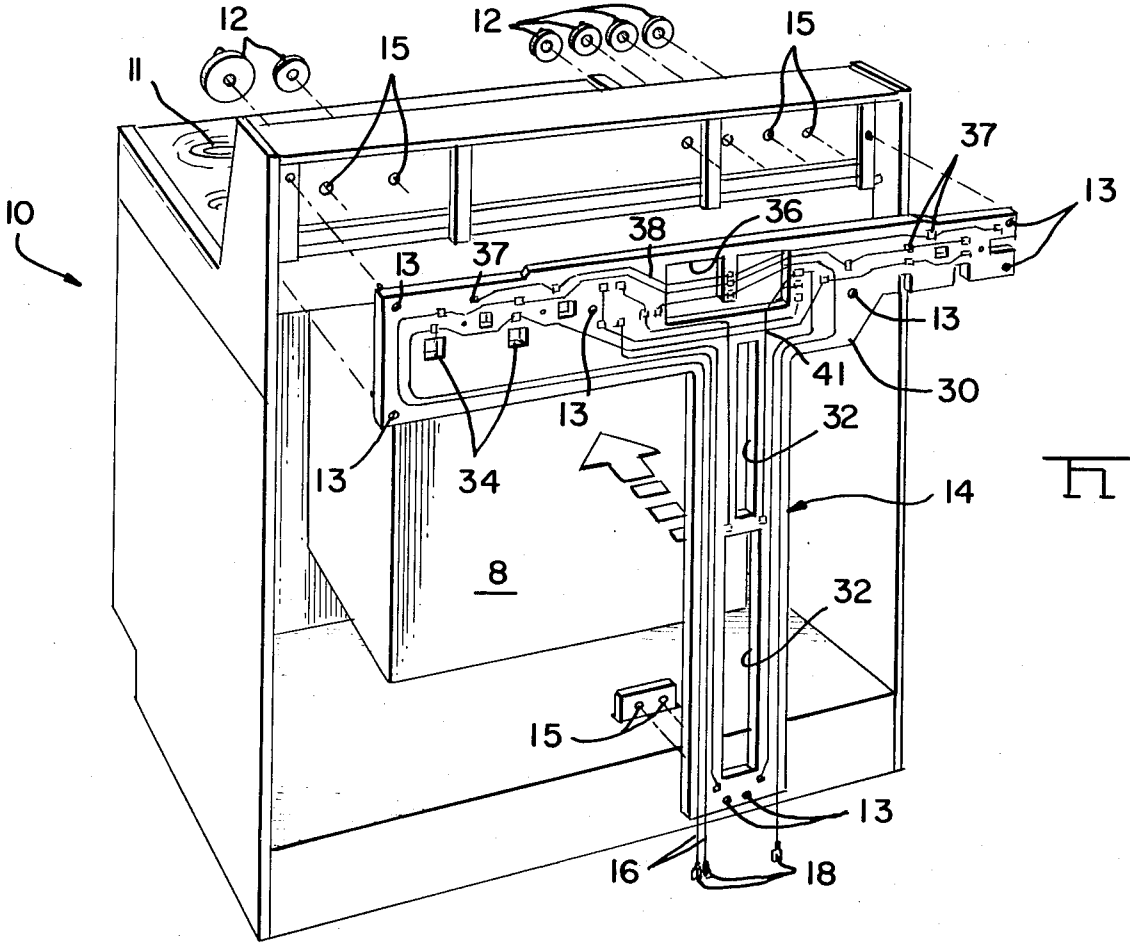
FIG. 2 is a schematic view, in perspective, of the rear of an electric range, partially exploded to show the structural element of the invention as it relates to such range.

FIG. 2 represents an alternative and improved approach related to the method and apparatus of the invention. In Figure 2, the harness 14 for the unit 10 is carried on a frame element 30 which is shown removed from the unit 10 for illustration. In conjunction with the use of the term "frame element", it is to be understood that the frame is structural and that the term structural should be taken in the context to mean that the frame serves a function in addition to or other than as merely an electric wire coordinator or means of mounting conductor wires. The invention contemplates frame or brace elements which are mechanically structural and support compressional or tensional loads in a given apparatus unit. Alternatively, structural may means that the element serves as a panel to cover over for utilitarian purposes the front, rear, top, side, or bottom of a given apparatus unit. Further to be understood is that the structural element may be buried within the apparatus to block access or seal off areas therewithin, as for example, within the door of an automobile or other vehicle. The structural element may be part of a panel or cover having utilitarian purposes and as well, esthetic value as the front or side panels of a computer housing.

With respect to the teaching of FIG. 2, the frame element 30 serves the disclosed purpose by functioning as a rack or mounting means for the distribution of wires 16 and terminals 18 as well as a means to provide interconnection and mechanical mounting of such interconnections. As will be hereinafter described, the frame also serves to mount components which are attached thereto.

Shown in FIG. 2 a part of the frame 30 are a series of mechanical fasteners illustrated by the showing of screws 13 which are carried in the frame as indicated and which engage and mate with apertures 15 in the frame of the unit 10. With the unit 30 secured as by the screws 13, the frame adds a structural bracing to the unit 10.

Referring now to further details of the frame unit 30, FIG. 3A shows a number of apertures including apertures 32 in the stem of the T of the frame which act to lighten and reduce the use of material in the frame. Apertures shown as 34 and 36 serve the same function and additionally, provide access to portions of the range beneath the frame and/or to components mounted thereon.

Referring now to FIG. 3A, the frame 30 is shown with the harness wires removed so as to reveal a series of further apertures 37 through which are positioned terminals not shown which interconnect to the conductor wires mounted on the frame as will be hereinafter described in greater detail relative to FIGS. 7A and 7B.

As can be seen particularly in FIGS. 3A and 3B, the frame 30 includes a series of grooves 38 formed in the body thereof to receive wire 16. FIG. 3B shows in cross section the lower left leg of frame 30 and it is to be noted that the detail of the grooves 38 includes a rounding in the bottom to accommodate wires laid therein and also a generally rounded or broken surface edge 40 which makes for an easy rolling entry of the wire 16 and tends to guide the wires into the grooves. To be noted also in FIG. 3A is the fact that the grooves 38 open at a number of places in the frame such as at 39 at the bottom end of the frame or in certain instances, into the apertures 37 distributed within the body of the frame. Also to be noted are certain cross over points shown as 41 which can and do occur throughout the pattern of grooves on the frame. As can be seen in the top center portion of frame 30, grooves 38 open also as at 39 around the periphery of the portions of the surface of aperture 36.

In an actual embodiment, frames such as 30 would be made in a variety of ways including by being molded of plastic or thermoformed as by vacuum forming of plastic sheet material. It is also contemplated that the frame may be stamped and formed of sheet metal such as steel or aluminum with all or portions of the surfaces thereof coated with a protective and insulating plastic material. In instances where fully insulated wire is employed, the frame so formed may be left with a simple oxidation resistant finish. The choice of material for the frame will, of course, depend upon the use, the need for strength, cost and tooling investment factors, and the like. Worth mentioning is the use for frame material of the so-called RIM method which stands for a Reaction Injection Molding process. RIM materials provide low mold cost since the molding takes place under very much reduced pressures and, more importantly to the present disclosure, it is a material which is light, readily deformed, having a somewhat porous characteristic.

Figure 4:
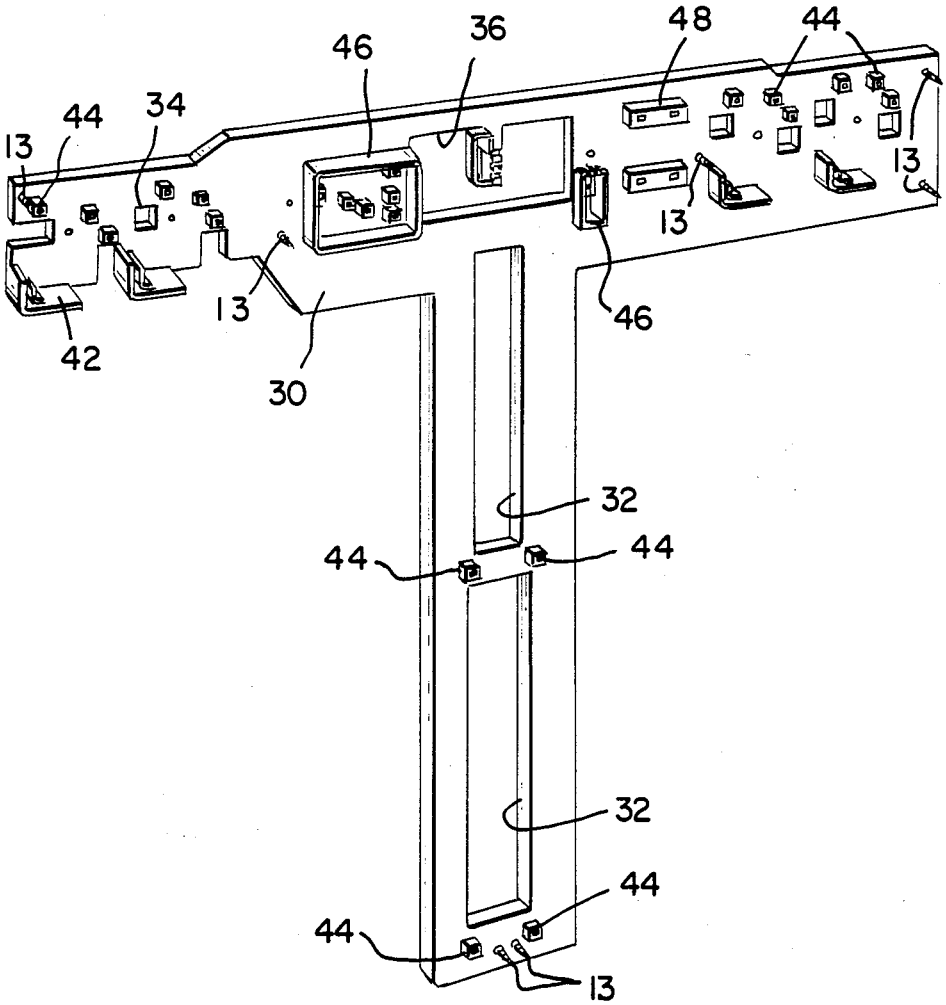
FIG. 4 is a perspective of the frame shown in FIG. 3A but from the front side thereof to include frame connector details.
Figure 9A:
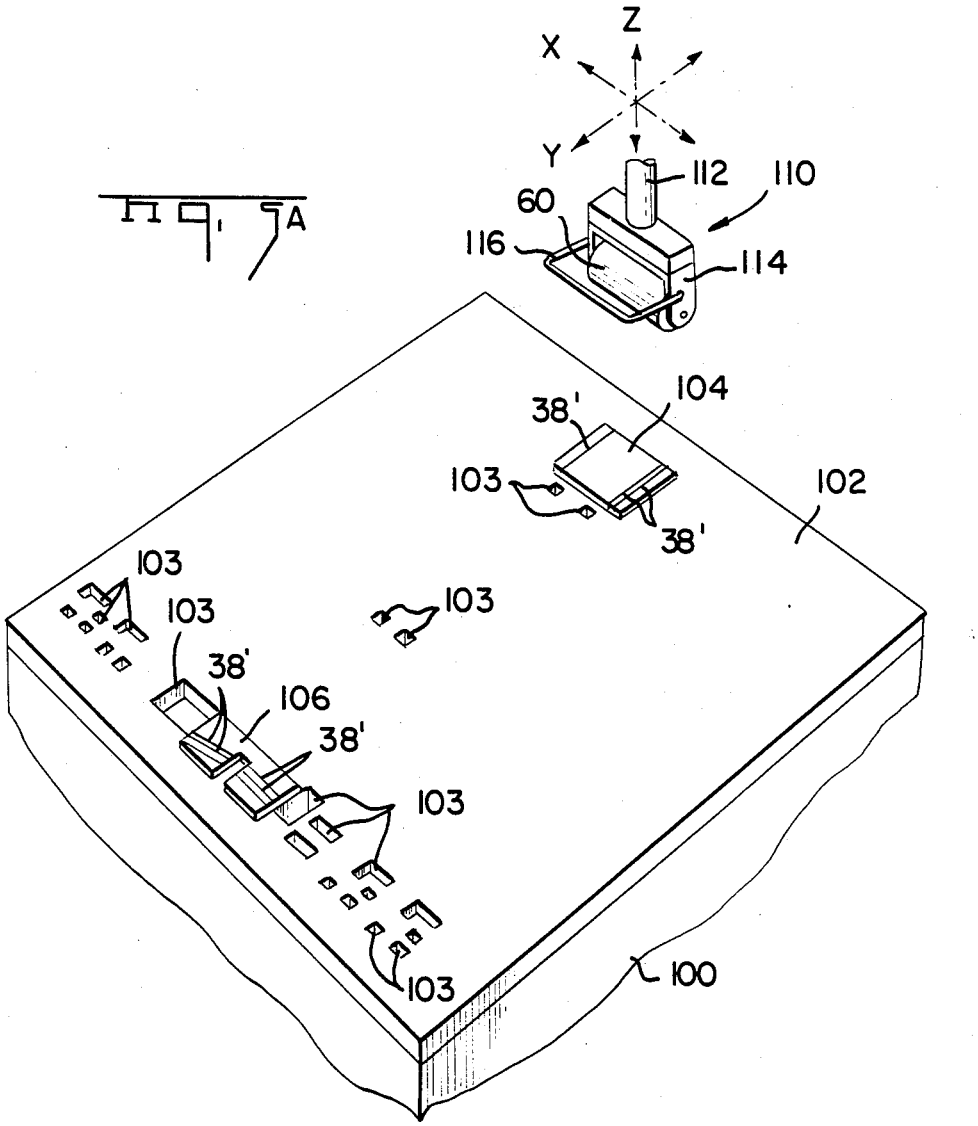
FIG. 9 is a view of an alternate embodiment illustrating numerous structural elements having free standing and relatively flexible wire between the elements.
Figure 7B:
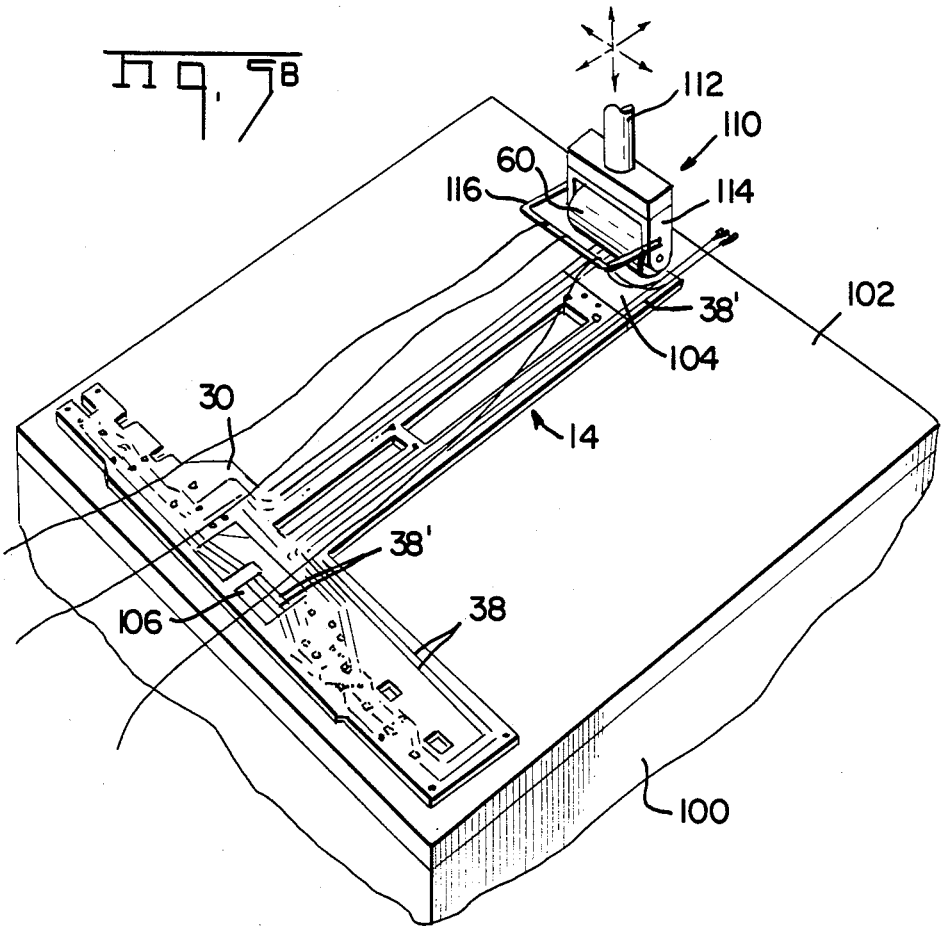

FIG. 4 shows the reverse side of frame 30 from that shown in FIG. 3A and reveals a number of projections which are molded or otherwise formed in a plastic material version of the frame. These projections are shown as 42, 44, 46, and 48 and represent different forms of extensions of the frame material to provide insulating, mounting, and protective functions relative to connector and component mounting. The projections 42 serve as an insulation and mounting means for the insertion of components which will be hereinafter described. Projections 44 surround and protect terminals fitted therewithin in a manner to be described relative to FIG. 7B. Projections 46 and 48 serve similar functions with respect to sets of terminals and with respect to components plugged therein. The invention concept embraces manufacture of frames wherein the projections 42–48 are integrally formed of the frame material as shown or; alternatively, being made of separate plastic or metal pieces attached by suitable fastenings to the base frame member at a later time. Versions where the projections may be in part integrally formed and in part added to the frame for electrical insulation or mechanical fastening of components are also contemplated. Note in FIG. 4 the presence of premounted screws 13 which are carried in the frame for mounting of the frame into the unit 10.

Turning now to the wire implantation technique of the method of the invention, reference is made to FIG. 5A. There represented is a table or jig base 100 carrying a jig 102 on the surface thereof, the jig may be seen to contain a series of recesses 103 adapted to accommodate the projections 42–48 heretofore described with respect to the frame element 30 and which in certain instances may serve to ease loading of the frame upon the jig by helping in alignment in the event of manual loading, and at least to preclude misalignment in the event of automatic or robotic loading. Included as part of the jig fixture 102 are a number of projections shown as 104 and 106. The projection 104 is in essence a tool having grooves 38 therein which match up with the grooves 38 in the frame element 30. The fixture element 106 has similar grooves 38 which match up with the grooves proximate to the aperture heretofore described as 36 in the top T part of frame 30. Shown positioned above the base 100 and jig fixtures contained thereon is an assembly 110 comprised of a supporting shaft 112 having brackets 114 carrying thereon a roller shown as 60. Secured to the roller is a bail mechanism 116 which preferably is added to the roller support bracket 114 and easily opened for loading of wires 16 to assist in implementation of wire implantation. Relative to the embodiment of FIG. 5A, it is contemplated that the shaft 112 would be fitted into an end effector retaining aperture of a robotic arm capable of driving the mechanism 110 in X, Y and Z movements indicated by the representation above the mechanism 110 in FIG. 5A.

Figures 5C, 5D:
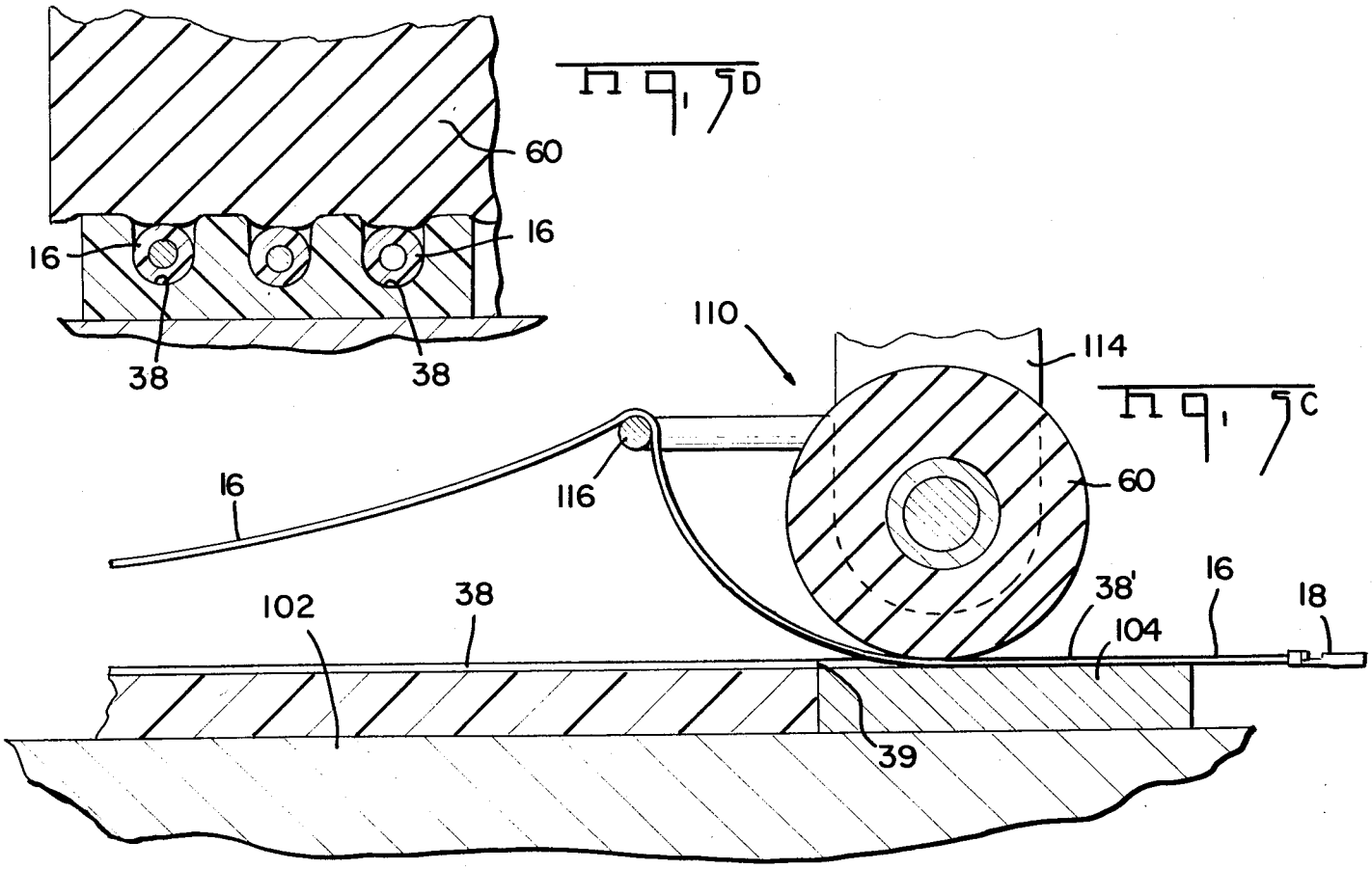
FIG. 5C is a side and elevational view of the roller as disposed in FIG. 5B.
FIG. 5D is a cross sectional view through lines 5D—5D of FIG. 5C showing the roller implanting wires in the frame element.
Figures 7A, 7B:
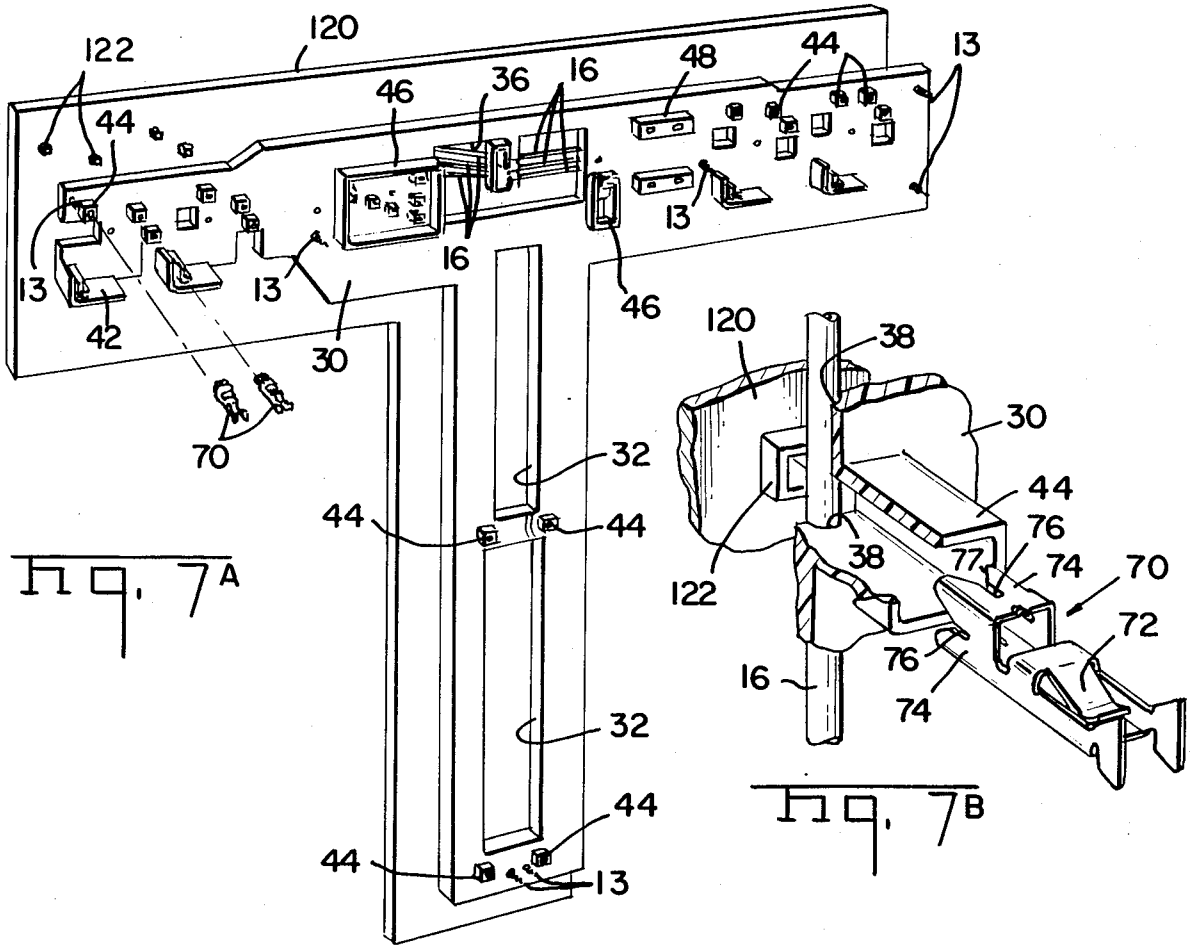
Figure 1:
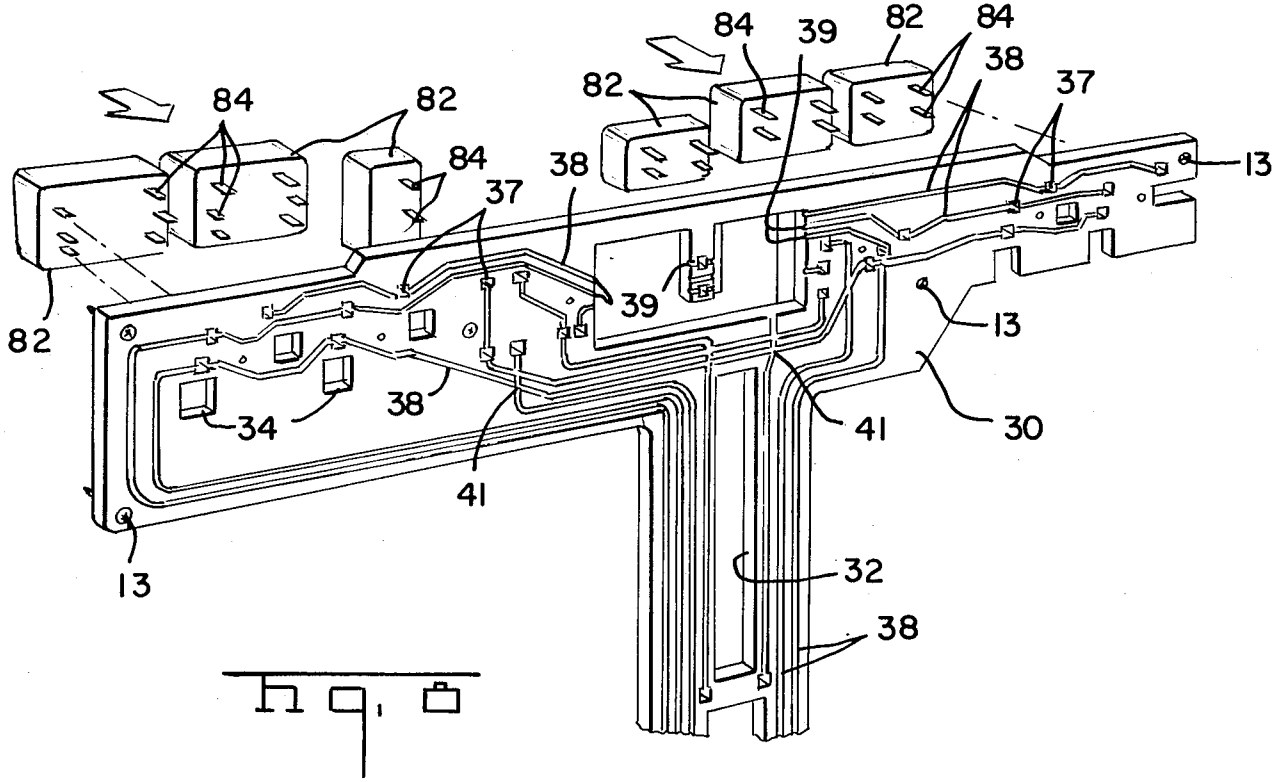

FIG. 5B shows the frame element 30 positioned on the surface of the jig fixture 102 with the jig elements 104 and 106 engaging the frame as shown. As can be discerned, the tooling elements 104 and 106 have their grooves 38' aligned with the grooves 38 of the frame 30. As shown in FIGS. 5B and 5C, the wires 16 preterminated as at 18 in this example, are placed through the bail 116 with wire end segments inserted into the grooves 38' of element 104. The wires 16 emerge from the grooves 38' of element 104 proximate to the entry surfaces 39 heretofore described and as shown in FIG. 5C. The roller 60 is brought downwardly to bear against the top of the element 104 and then the mechanism 110 is caused to move in an initial Y direction, pressing the wires 16 into the grooves of the frame 30 as is depicted in FIG. 5D.

The roller 60 is made of elastomeric material of a sufficient flexibility to press the wire 16 beneath the surface of 30. As an alternative construction, the roller 60 may be formed of the composite metal core having a sleeve of elastomeric material thereover sufficient to effect the deformation shown in FIG. 5D. In accordance with the invention, the mechanism 110 and roller is driven in a path represented by the dotted line in FIG. 5B to implant the three wires that are there shown. It is to be understood that in many instances there would be fewer wires and in most instances, a greater number of wires implanted in grooves in frames.

Referring back to FIG. 3A, it will be apparent that there is need to add additional wires which do not start at the bottom end of the T-shaped frame but rather at the apertures 37 located within the body of the frame. It will also be discerned that certain of the wires begin in the top right-hand portion of the T-shaped frame and end in such top portion. These wires would need to be added subsequent to the initial rolling operation shown in FIG. 5B. In accordance with the invention, the relative movement between the roller and the jig fixture embraces having the roller track or turn as is necessary to accommodate the bends of the grooves 38 as well as initiating and effecting roller sweeps in X or Y or X and Y paths traversing the surface of the frame element 30. As a part of the invention, the use of the jig fixture tooling element 106 allows wires to be laid continuously along the grooves 38 in the frame element and through the grooves 38' in the surface of the tooling fixture element 106. With the frame removed from the jig, these wires will be left free standing as is shown in Figures 7A and 8.

Figure 9:
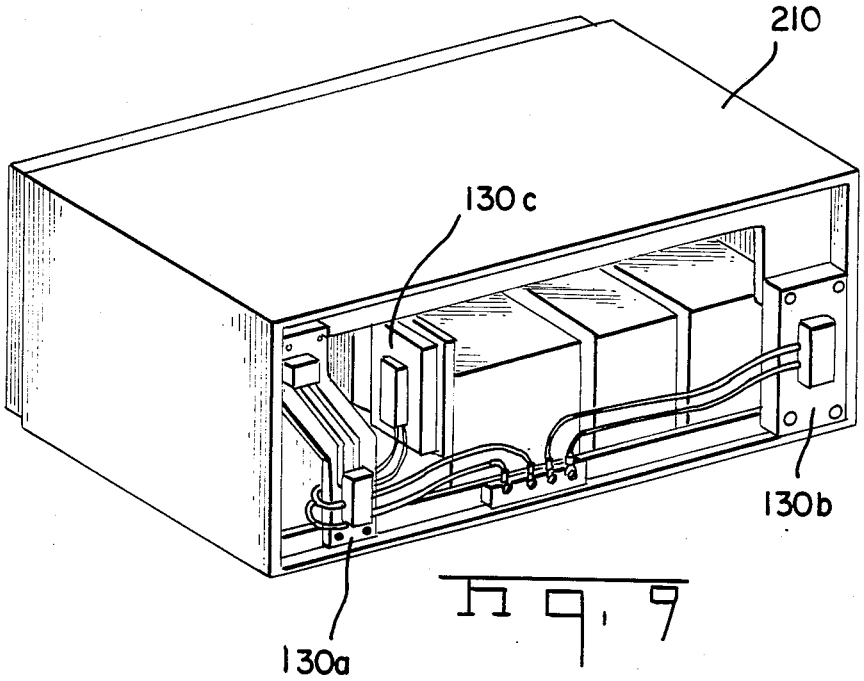

To this end, the invention contemplates the provision of free standing wires where necessary to lend flexibility to the invention method and article concept. It is also contemplated that multiple elements such as 104 could be employed at the ends or in the body of a given frame or between separate frame structures which each serve their own structural function as well as serving as a medium for a wire path and distribution. Reference is drawn to FIG. 9 in which such an embodiment is shown as including several structural element components such as 103*a*, 130*b* and 130*c*. This embodiment is advantage when the structural elements need to be disposed in distinct planes from one another, as is shown in FIG. 9. It should be noted however, that this embodiment can be used when the structural elements are to be used within the same plane, but spaced apart, this embodiment producing a cost savings in that the structural element is not material intensive. It should also be noted that this configuration would include a smaller overall envelope for shipping and/or storage purposes.

Figure 10:
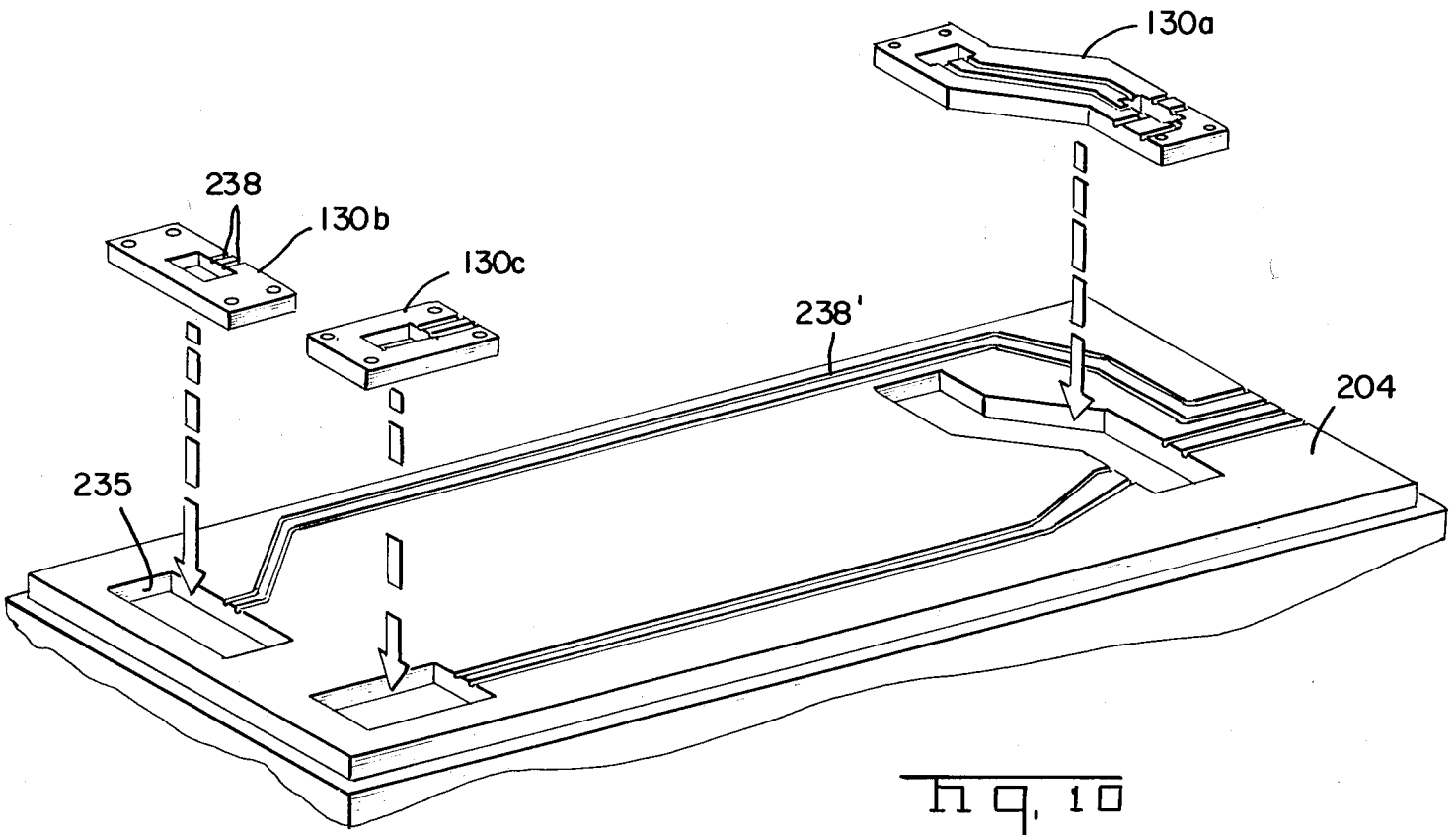
FIG. 10 is a view of a fixture which can be used to insert the wires into the configuration as shown in FIG. 9.

Thus it is believed that the tool jig fixture element could be made several feet in length if desired, as shown in FIG. 10 as 204 resulting in there being several feet of wires 16 suitably terminated or not, which could then be made flexible to interconnect at any suitable point inside the apparatus unit 210 and not proximate to the frame element itself. When the structural elements are disposed within the apertures 235, the the grooves 238' and 238 are aligned for rolling in the wires 16 as hereinbefore described. The lengths of the grooves 238' between each aperture 235 will be the length of the free standing wire between the structural elements 130*a*, 130*b*, and 130*c*.

Figure 11:
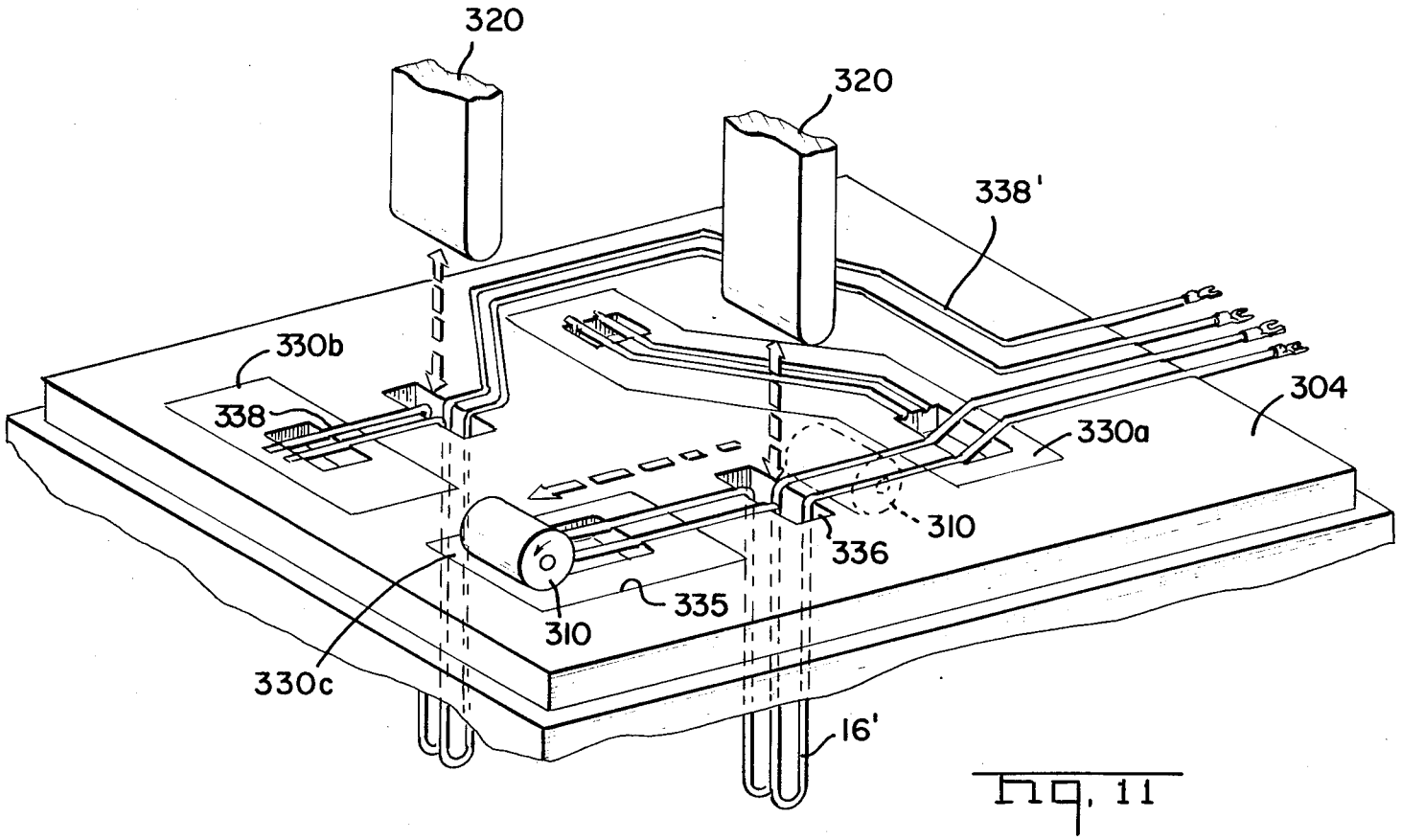
FIG. 11 is a view of an alternate fixture which can be used to insert the wires into the configuration as shown in FIG. 9.

Alternatively, the tool jig fixture could be made more compact or from several unitary fixtures, in any event where the apertures 235 are more closely spaced, as shown in FIG. 11. The fixture 304 includes a plurality of apertures 335 for the receipt of the structural members 330*a*, 330*b* and 330*c*, which when inserted have grooves 338 and 338' aligned for receipt of wires 16. When the roller 310 traverses the fixture 304 to a position directly behind the aperture 336 (shown in phantom), a tooling bar 320 moves vertically downward through the aperture 336 to provide a length of free standing wire 16'. For the same application, the length of the free standing wire would be the same length as the length of the grooves 238' as shown in FIG. 10. Although somewhat more complicated, the process shown in FIG. 11 requires less physical area and of course, less travel of the roller assembly, due to the proximity of the apertures 335.

Referring again to FIGS. 5A–5D, the embodiment is shown such that the jig fixture bases are fixed and the roller and mechanism are movable up and down and in X and Y senses, it is contemplated that the mechanism may be made to have only a Z motion up or down with the base being made movable in X and Y directions as a typical X—Y driven table widely used in industry today. In such event, the table carrying the frame would move under the fixed mechanism, the roller of course rotating as necessary to implant wires in grooves appropriately.

In FIG. 5C, the ends of the wires 16 are shown as terminated by the addition of terminals 18. It is contemplated that the wires may be terminated following the wire rolling operation step by using the frame itself to hold the wires and position them relative to terminal crimping machinery. This applies, of course, to those wires left extending from the frame.

Referring now to FIG. 6A, a representative segment of the lower leg of the frame 30 is shown as element 62 including grooves 38 having a representataive wire 16 laid in the right-hand groove. The grooves 38 are made to include periodically therealong wire retaining indentations shown as 64 in FIG. 6A which tend to pinch the wire, compressing the insulation thereof and locking or fixing the wire within the grooves. The wire retaining structure represented by 64 would be chosen to accommodate the wire diameters employed with the frame in a light wedging fit, holding the wires but readily allowing the wires to be pressed therewithin by the action of the roller 60. Elements 64 may be molded into the frame with its initial manufacture.

FIG. 6B shows an alternative embodiment wherein the body of the material of element 62 is made to include between the grooves 38 a number of apertures shown as 66 which can be deformed to lock the wires in place within the grooves. In FIG. 6B, the aperture 66 is shown as molded in the lower portion thereof and as deformed in the upper portion thereof. As can be discerned from FIGS. 6B and 6C, the deformation of the walls surrounding 66 creates a bulge 68 locking the wires within the grooves. FIG. 6C shows an example to the left of a conductor wire 16 having insulation thereon and to the right of a conductor wire 16' which is solid and uninsulated. With respect to the embodiments of FIG. 6B and 6C, the frame would be employed as heretofore described with the wires being rolled therein and thereafter, an additional mechanism such as 110 having an end effector carrying a tool to effect deformation of the frame as at 66, would be employed. The embodiment of FIG. 6B and 6C would be preferred in the case of the use of wire of different diameters which might not have a wedging fit and thus be otherwise retained within the groove 38.

FIG. 6D shows a section of the frame 30 wherein grooves 38 cross one another, allowing wires 16 to cross one another in an overlapping configuration. This cross over point is evidenced in the FIGS. 2 and 3A by numeral 41. In accordance with the invention, one of the wires, the lower wire 16, would be first rolled into position within its groove with the second wire run being subsequently rolled and with the frame being made to accommodate the volume of the two wires in a vertical sense.

While the invention as thus far illustrated has shown grooves receiving wires in a wedging fit, and means in the frame which can operate to lock wires within the grooves, other and more conventinal means of tying the wires to the grooves including the use of tape or adhesive, screws, or other fasteners is of course also contemplated.

Figure 7A:
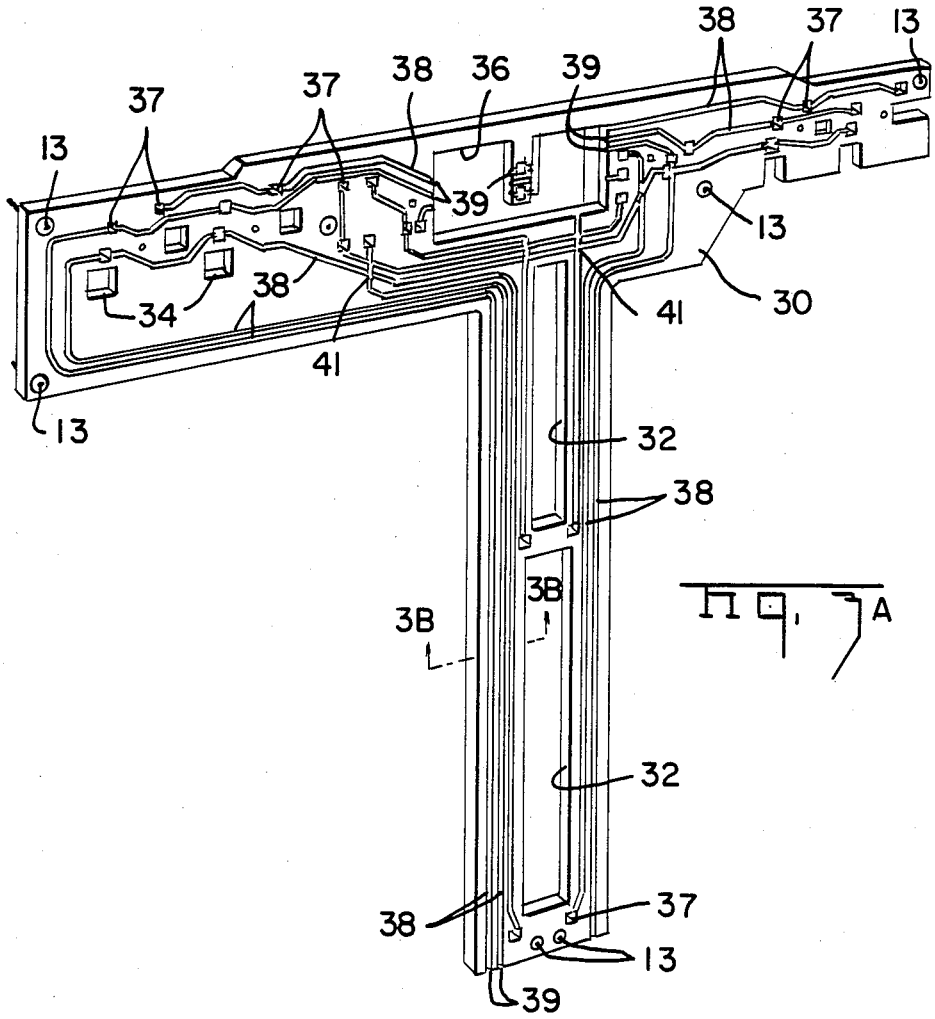
FIG. 7A is a perspective view of the rear of the frame element of the invention with terminals shown just prior to insertion for wire termination.
Figure 7B:
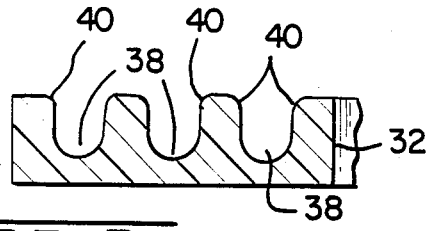
FIG. 7B is an enlarged view of the wire termination features including the terminal shown in perspective relative to the frame wire and anvil tooling.

FIGS. 7A and 7B show a further aspect of the invention with the frame 30 following wire layment to form a harness and with the frame positioned relative to a further jig shown as 120 having a series of projections shown as 122 extended over the surface thereof in alignment with the apertures 37 heretofore mentioned. In accordance with the teaching in FIGS. 7A and 7B, a frame having the wire 16 implanted therein in the manner heretofore described, is positioned over the jig fixture 120 with the projections 122 forming anvils and then with the terminals pressed into the frame as indicated by the arrows in FIGS. 7A and 7B to terminate the wires within the slots 76, the beveled portions 77 serving to center the wires and assist their entry within the slots.

With the frame 30 being brought onto the jig base 120, the wire 16 may be terminated by a series of terminals shown as 70 in both FIGS. 7A and 7B. The terminals 70 include forwardly extending contact spring elements 72 shaped and formed to receive terminal blades inserted therein in the manner shown in FIG. 8, which terminal blades interconnect components as will be described. The base of each of the terminals 70 includes a series of flat, plate-like projections 74 each containing a slot 76 ending in a beveled portion 77 which forms the well-known termination concept known as insulation displacement and widely referred to as IDC or Insulation Displacement Connector. The terminal 70 is typically formed out of a suitable conductive sheet metal material such as a brass or phosphor-bronze stamped and formed and where necessary plated, with the spring elements 72 made to have suitable characteristics for repeated plugging in of tabs or blades. The characteristics of the metal must include sufficient strength in conjunction with the geometry and thickness thereof to provide slotted beam structures formed by the slots 76 to grip and hold the conductive portions of the wire 16 while penetrating the insulation thereof during insertion of the wires within the slot. The terminals are further provided with one or more barbs such as 78 shown in FIG. 7B which operate to engage portions of the plastic material of the element 44 interiorly thereof to lock the terminals to the frame.

Alternatively, the terminals 70 may be partially preloaded into the frame, being inserted from the rear thereof with surfaces such as 78 engaging the interior of the plastic portions 44, and with the end edges 77 forming a trough at a depth substantially equal to the depth of the grooves. Thereafter, the wires may be rolled into the slots with the wire portions resting within the troughs formed by the outer ends 77 of the contacts. The contacts would be punched down such that the wires are terminated into the slots by anvils (not shown), the frame selectively being held with sufficient bearing surfaces proximate to 44 to avoid undue stressing of the frame and the boxlike structures formed by the terminals. As can be discerned from FIG. 7B, the terminals 70 in their boxlike structures include slotted beam structures arranged at right angles so as to accommodate wires 16 laid in grooves arranged in X or Y directions to make the terminal more universal with respect to orientation. Preferably the terminal 70 would be positioned in the frame cavity with the terminal contact element 72 having only a single orientation. Termination could still be made to conductors oriented in either of the two orthogonal directions. It is contemplated that slot 76 may be made sufficiently long so as to permit commoning of two wires laid in a cross over relationship as heretofore described to effect electrical commoning or to provide an output from two separate wires 16. A further alternative which is contemplated includes fully inserting the terminals within the frame and subsequently rolling the wires directly into the IDC slots 76 of the terminals.

FIG. 8 shows a wire harness formed in a frame 30 with components 82 aligned and positioned to be plugged into the frame. Terminals 84 are included on each component to engage the terminals 70 as heretofore described. The components 82 may be taken to include the usual components of electrical, electronic and electrically powered apparatus of all kinds. They may contain switches or timers, lights or solid state packages including logic and memory, fuse boxes, transformers, various sensors, detectors, and so forth. The components 82 are plugged into the frame to engage with the portions heretofore shown in FIGS. 4 and 7A. With the components 82 plugged into the frame 30 and supported thereby by portions 42–48, the frame may be tested out and then installed into the apparatus unit 10 with the fastening means 13 locking the frame into the unit as a permanent structural part thereof. Thereafter, the knobs 12 may be added to the components. It is contemplated that a frame 30 may be installed as wired and terminated into a unit with the components 82 added thereafter and during the production asssembly phase of manufacturing if there is sufficient access. In the illustrative embodiment here shown, such access is not provided but it may in many instances allow for an access.

With respect to the figures heretofore discussed and described, the preferred embodiment of the invention method and an illustrative apparatus has been shown to effect provision of a wiring harness incorporated into a structural frame or electric range, along with suitable termination, interconnection and components.

A wide variety of variations in frame shape, geometry, and type are contemplated as well as variations in method.

With respect to the teaching in this disclosure, reference has been made to a roller to effect implantation of wires and reference has been made to certain U.S. Patents that teach the employment of rollers. It is also contemplated that in certain applications, particularly those where wiring insertion involves grooves of a short length and small size, the insertion or implantation of wires may be accomplished by an edge of plastic or other material driven along the surface of the element containing the grooves. This concept of using a non-roller action to implant wires is taught in U.S. Pat. No. 4,132,252.

As has been heretofore detailed, the invention contemplates the use of a structural member containing grooves into which wires are implanted, with a segment of wires placed within a groove and thereafter the remainder of the wire driven by means such as a roller into the remainder of the groove. The invention contemplates starting or initiating the wire in the groove of a tool as part of a fixture or in a portion of the groove within the frame element itself. In certain instances and applications, all starting segments of wires may be displaced in appropriate tools or in certain instances, all may be started within the grooves of the frame. Both are contemplated in the sense that there is an end segment placed within the groove followed by an implantation effected as by rolling.

Having now described and disclosed the invention relative to drawings, we set forth the scope thereof in the appended claims.

We claim:

1. In a method for wiring apparatus of a type characterized in having a multi-element housing including a variety of components interconnected by electrical wires, the steps comprising:

a. providing an element which is a structural part of said apparatus including substantial portions residing in a plane to define a flat surface with grooves in said element opening onto said surface, said grooves being disposed in a pattern to define major portions of a harness interconnecting the components of the said apparatus, b. inserting conductor wires in one segment of the said grooves, c. positioning a wire insertion means over said one segment and drawing said means over the said flat surface in bearing engagement therewith to drive the said wires into the said grooves along the remaining length of the said grooves in said surface, and d. terminating said wires in said element at appropriate positions to provide interconnection for the said components.

2. The method of claim 1 wherein following the said step of driving the said wires into said grooves, there is included a further step of deforming portions of said element to lock said wires in said grooves.

3. The method of claim 1 wherein there is included following the step of terminating said wires in said element, the step of connecting components to said wires and mounting said components on said element.

4. The method of claim 1 wherein following the said step of terminating said wires, there is included the step of inserting the said element into the said apparatus and affixing the said element to the said housing as a permanent structural part thereof.

5. In a method for wiring apparatus of the type having a multi-element housing containing a plurality of components requiring conductive wiring interconnection therebetween, the steps comprising:

a. providing element means which is a structural part of said apparatus with substantial portions of one side thereof defining a plane surface, there being grooves in said element opening onto said plane surface, said grooves extending in a pattern to interconnect intersecting apertures for insertable components, said apertures being in said element periodically therealong, b. inserting one segment of each wire in one segment of each groove, c. applying a roller means to said one element overlaying said segment of wire and in bearing engagement with the surface thereof, d. effecting relative movement between the said element and the roller means along the length of the groove in the said one element and thereafter into the grooves of the other of said elements along the length thereof to define said harness, and e. terminating said wires in said element by applying terminals through said apertures in order to interconnect the said components of said apparatus preparatory to insertion of said element into said apparatus as a permanent structural part thereof.

6. The method of claim 5 wherein the element is provided as a single unitary structure having support means extending between the plurality of apertures.

7. The method of claim 6 wherein the insertion step includes the further step of placing the element onto a fixture including raised surfaces which substantially fills a void created by said apertures, the raised surfaces include grooves therein which interconnect the grooves in the element which pass over the voids.

8. The method of claim 5 wherein the element means is provided as a plurality of individual element members, each member including an aperture for at least one component.

9. The method of claim 8 wherein the insertion step includes the further step of placing the several element members onto a fixture which includes cavities in the surface of the fixture for receiving the element members and raised surfaces within the cavities profiled for filling a void created by said apertures for said components.

10. The method of claim 8 wherein the insertion step includes the further step of providing a plurality of spaced apart fixtures each fixture including cavities for receiving the elements and raised surfaces profiled to fill the voids created by said apertures.

11. The method of claim 10 wherein the step of effecting relative movement between the element and the roller means includes the step of moving the wires in a predetermined distance away from the previous fixture to provide a predetermined length of wire between said elements.

12. The method of claim 5 wherein the step of effective relative movement between the element and the roller means includes the further step of positioning a roller means over each said segment as inserted in said groove and driving said roller means in bearing engagement over the said surface of said element to force said wires into said grooves along the remaining length thereof.

13. The method of claim 5 wherein the step of effecting relative movement between the element and the roller means includes the further step of positioning the roller means over each segment and moving the element relative to the stationary roller means.

14. The method of claim 5 wherein there is included at least two elements, with the one element positioned within the body of the other element whereby upon removal, a span of free standing wire is left within the outline of the said other element.

15. The method of claim 6 where there is included at least two elements, with the said one element being spaced from the other element whereby upon removal, a span of free standing wire is left extending between the said elements to permit flexibility of a portion of said wires.

16. As an article of manufacture for installation as a structural part of an apparatus, the combination comprising frame means including fastener means operable to secure said frame means to said apparatus as a structural part thereof, said frame means including in substantial parts thereof and on one side thereof, planar surfaces containing a series of grooves, electrical conductive wires disposed in said grooves and fixed therein against displacement, terminating means terminating said wires in various locations in said frame, said terminating means including means to mate with and interconnect with said wires to electrical components of said apparatus, the said frame means including on one side thereof portions serving to insulate said termination means and mount said components.

17. The article of claim 16 incuding means to mechanically attach said components to said frame.

18. As an article of manufacture for installation as a structural part of an apparatus, the combination comprising frame means adapted to be attached to the housing of said apparatus, said frame means including in substantial portions thereof, a pattern of grooves outlining a wiring harness serving to define the circuit of said apparatus, a plurality of electrically conductive wires disposed in said grooves and fixed to said frame, terminating means terminating said wires in various locations in said frame, said terminating means including means to mate with components used with said apparatus, said terminating means further including insulation piercing slots adapted to terminate said wires and means for locking said terminating means to said frame as an integral part thereof.

19. The article of claim 18 wherein there is further provided fastening means as part of said frame means located proximate to said grooves and deformable to lock said wires in said grooves and thus to said frame means.

20. The article of claim 18 wherein there is further provided fastening means as part of said frame means extending into the said grooves to retain said wires therein and thus retain said wires to said frame means.

21. As an article of manufacture, a combination including at least one stamped and formed terminal for terminating at least one electrical conductor oriented in either of two orthogonal directions and frame means; each terminal comprising a conductor terminating portion having a box-like configuration including four sides, each side having a conductor receiving slot extending inwardly from one end and a terminal contact element extending from at least one of the sides of the conductor terminating portions, the frame means including at least one cavity including means for receiving a terminal having only one orientation relative to the housing, whereby conductors in either of two orthogonal directions can be terminated without changing the orientation of the terminal contact section relative to the housing.

22. The article of claim 21 wherein the frame means includes a conductor receiving groove for each conductor intersecting at least one cavity; each groove extending in one of the two orthogonal directions at the intersection with the cavity.

* * * * *